US011148844B2

(12) United States Patent
Guzman et al.

(10) Patent No.: US 11,148,844 B2
(45) Date of Patent: Oct. 19, 2021

(54) WRAPPING MACHINE AND ASSOCIATED CONTROL SYSTEM

(71) Applicant: ILLINOIS TOOL WORKS INC., Glenview, IL (US)

(72) Inventors: Juan C. Guzman, Dayton, OH (US); Robert S. Davis, Tipp City, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 280 days.

(21) Appl. No.: 15/787,776

(22) Filed: Oct. 19, 2017

(65) Prior Publication Data

US 2018/0118395 A1 May 3, 2018

Related U.S. Application Data

(60) Provisional application No. 62/482,967, filed on Apr. 7, 2017, provisional application No. 62/414,167, filed on Oct. 28, 2016.

(51) Int. Cl.
*B65B 11/02* (2006.01)
*B65B 11/08* (2006.01)
(Continued)

(52) U.S. Cl.
CPC ..... *B65B 57/08* (2013.01); *B65B 11/02* (2013.01); *B65B 11/08* (2013.01); *B65B 11/54* (2013.01);
(Continued)

(58) Field of Classification Search
CPC ..... B65B 11/54; B65B 57/08; B65B 11/08; B65B 35/10; B65B 41/12; B65B 57/18
(Continued)

(56) References Cited

U.S. PATENT DOCUMENTS 3,908,815 A * 9/1975 Carter ..... B65G 43/08 198/341.07
4,458,470 A 7/1984 Fine
(Continued)

FOREIGN PATENT DOCUMENTS

| | | |
|---|---|---|
| EP | 1036738 | 9/2000 |
| EP | 1807308 | 7/2007 |
| WO | WO 2015/178055 | 11/2015 |

OTHER PUBLICATIONS

PCT, International Search Report and Written Opinion, International Application No. PCT/US2017/057288; dated Mar. 21, 2018, 17 pages.

(Continued)

*Primary Examiner* — Thanh K Truong
*Assistant Examiner* — Patrick B Fry
(74) *Attorney, Agent, or Firm* — Thompson Hine LLP

(57) ABSTRACT

A wrapping machine for wrapping trayed food products includes a wrap station at which trayed food products are wrapped, a film dispensing station for drawing out film over trayed food products at the wrap station and a conveying system for moving trayed food products along a defined path from an input station to the wrap station. A controller is operatively connected to operate the conveying system, components of the film dispensing station and components of the wrap station. The controller is configured as a state machine with sequential wrap stages, where each wrap stage must successfully complete before the controller initiates a next wrap stage.

5 Claims, 7 Drawing Sheets

(51) Int. Cl.

| | |
|---|---|
| ***B65B 11/54*** | (2006.01) |
| ***B65B 25/06*** | (2006.01) |
| ***B65B 35/10*** | (2006.01) |
| ***B65B 35/24*** | (2006.01) |
| ***B65B 41/12*** | (2006.01) |
| ***B65B 41/16*** | (2006.01) |
| ***B65B 57/00*** | (2006.01) |
| ***B65B 57/08*** | (2006.01) |
| ***B65B 57/12*** | (2006.01) |
| ***B65B 57/18*** | (2006.01) |
| ***B65B 59/00*** | (2006.01) |
| ***B65B 61/26*** | (2006.01) |

(52) U.S. Cl.
CPC ..... *B65B 25/065* (2013.01); *B65B 35/10* (2013.01); *B65B 41/12* (2013.01); *B65B 57/00* (2013.01); *B65B 57/12* (2013.01); *B65B 57/18* (2013.01); *B65B 59/001* (2019.05); *B65B 59/003* (2019.05); *B65B 35/24* (2013.01); *B65B 41/16* (2013.01); *B65B 61/26* (2013.01); *B65B 2210/04* (2013.01)

(58) Field of Classification Search
USPC ..... 53/53; 73/507
See application file for complete search history.

(56) References Cited

U.S. PATENT DOCUMENTS

| | | | | |
|---|---|---|---|---|
| 4,757,451 | A * | 7/1988 | Denda | B65B 11/54 53/228 |
| 4,781,215 | A | 11/1988 | Mayhall, Jr. | |
| 4,813,211 | A * | 3/1989 | Treiber | B65B 11/54 53/223 |
| 4,825,626 | A | 5/1989 | Treiber | |
| 4,944,135 | A | 7/1990 | Treiber | |
| 4,958,479 | A | 9/1990 | Treiber | |
| 5,115,620 | A * | 5/1992 | Takamura | B65B 57/00 53/222 |
| 5,144,787 | A | 9/1992 | Whitby | |
| 5,606,849 | A | 3/1997 | Bettenhausen | |
| 5,653,093 | A * | 8/1997 | Delledonne | B65B 11/54 53/141 |
| 5,655,356 | A | 8/1997 | Ginestra | |
| 5,713,185 | A | 2/1998 | Lindström | |
| 5,718,100 | A | 2/1998 | Petty | |
| 5,943,844 | A | 8/1999 | Wilhelm | |
| 6,109,007 | A | 8/2000 | Combs | |
| 6,170,236 | B1 | 1/2001 | Whitby | |
| 6,247,292 | B1 | 6/2001 | Whitby | |
| 6,505,459 | B1 | 1/2003 | Ruohio | |
| 6,658,820 | B2 | 12/2003 | Whitby | |
| 6,729,357 | B2 | 5/2004 | Marsche | |
| 6,851,250 | B2 | 2/2005 | Whitby | |
| 6,877,297 | B2 | 4/2005 | Armington | |
| 6,938,397 | B2 | 9/2005 | Miller | |
| 6,955,029 | B2 | 10/2005 | Palumbo | |
| 7,530,210 | B2 | 5/2009 | McGuinness, Jr. | |
| 7,814,733 | B2 * | 10/2010 | Carlson | B65B 55/20 493/25 |
| 8,393,133 | B2 | 3/2013 | Parmley | |
| 2003/0145560 | A1 | 8/2003 | Melville | |
| 2005/0126123 | A1 | 6/2005 | Chase | |
| 2007/0051075 | A1 | 3/2007 | Chiu Chen | |
| 2010/0018154 | A1 * | 1/2010 | Laperche | B07C 5/342 53/53 |
| 2014/0144757 | A1 * | 5/2014 | Hamada | G01P 3/68 198/804 |
| 2017/0057680 | A1 * | 3/2017 | Schlichting | B65B 57/18 |

OTHER PUBLICATIONS

PCT, International Search Report and Written Opinion, International Application No. PCT/US2017/057288; dated Jan. 25, 2018, 12 pages.

* cited by examiner

WRAPPING MACHINE AND ASSOCIATED CONTROL SYSTEM

CROSS-REFERENCES

This application claims the benefit of U.S. Application Ser. No. 62/414,167, filed Oct. 28, 2016 and U.S. Application Ser. No. 62/482,967, filed Apr. 7, 2017, both of which are incorporated herein by reference.

TECHNICAL FIELD

This application relates generally to wrapping machines and, more specifically, to a food product wrapping machine and associated control system with closed-loop sequential operation.

BACKGROUND

Packaging machines are frequently used to automatically wrap film about product, such as trayed food items. The packaging machines typically include a film gripper that grips and pulls the film from a roll of film, side clamps that grip the film, and folders that fold the film underneath the product.

The external inputs to such an automatic wrapping system contain various characteristics that complicate the successful wrap of fresh product (meat, seafood, etc.). These inputs include, for example, film (specific gauge, ambient temperature), trays (size, brittleness, ambient temperature), and operator (placement of the tray into the system, knowledge of the operation of the machine, amount and placement of the fresh item product on the tray).

It would be desirable to provide an automated wrapping machine with a control system that operates based upon feedback to manage the variability of the wrapping process due to the external inputs and normal wear of the system over time.

SUMMARY

In one aspect, an automated wrapping machine control system includes closed feedback operation that accounts for when command actuation or movement of mechanical structures has occurred, wrapping process changes that must occur to handle varying size and weight of a tray, whether motors have moved to actuate a knife or move the tray on a belt, whether the tray is in the right location and centered, appropriate pressure is in the pneumatic system, film has been grabbed and pulled by gripper and side clamps, the knife has cut the film, tray has been wrapped from top to bottom, tray has been labeled, and/or when the next package is present to be wrapped.

In another aspect, a wrapping machine for wrapping trayed food products includes a wrap station at which trayed food products are wrapped, a film dispensing station for drawing out film over trayed food products at the wrap station and a conveying system for moving trayed food products along a defined path from an input station to the wrap station. A controller is operatively connected to operate the conveying system, components of the film dispensing station and components of the wrap station. The controller is configured as a state machine with sequential wrap stages, where each wrap stage must successfully complete before the controller initiates a next wrap stage.

In a further aspect, a wrapping machine for wrapping trayed food products includes a wrap station at which trayed food products are wrapped, a film dispensing arrangement for drawing out film over trayed food products at the wrap station and a conveying system for moving trayed food products along a defined path from an input station to the wrap station. A controller is operatively connected to operate the conveying system, components of the film dispensing station and components of the wrap station. Multiple feedback arrangements are provided, including at least one feedback arrangement associated with a component of the wrap station and a feedback arrangement associated with a component of the film dispensing station. Each feedback arrangement includes one or more of a respective home or start sensor, a respective end of travel sensor and/or a respective encoder for tracking component movement. The controller is configured to carry out a wrap operation in a plurality of sequential wrap stages and the controller utilizes feedback from one or more of the feedback arrangements to assure that one wrap stage is complete before initiating a next sequential wrap stage.

In yet another aspect, a wrapping machine for wrapping trayed food products includes a wrap station at which trayed food products are wrapped and a film dispensing arrangement for drawing out film over trayed food products at the wrap station. A conveying system moves trayed food products along a defined path from an input station to the wrap station. A controller is operatively connected to operate the conveying system, components of the film dispensing station and components of the wrap station. Multiple feedback arrangements are provided, including at least one feedback arrangement associated with a component of the wrap station and a feedback arrangement associated with a component of the film dispensing station, wherein each feedback arrangement includes one or more of a respective home or start sensor, a respective end of travel sensor and/or a respective encoder for tracking component movement. The controller is configured to monitor state times associated with operation of the components over time and to (i) output an alert if one or more monitored state times degrades by a specified amount indicative a potential problem and/or (ii) wrap trays at a slower rate than specified as necessary to adapt for degraded operating speed of one or more components.

The details of one or more embodiments are set forth in the accompanying drawings and the description below. Other features, objects, and advantages will be apparent from the description and drawings, and from the claims.

DETAILED DESCRIPTION

Figure 1:
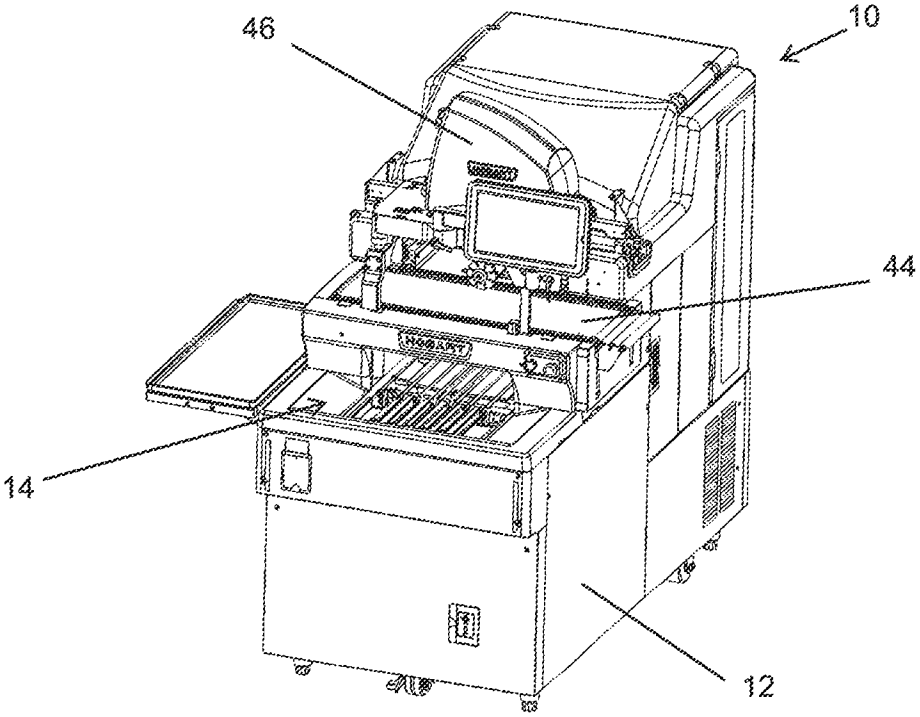
FIG. 1 shows a perspective front view of a wrapping machine.
Figure 2:
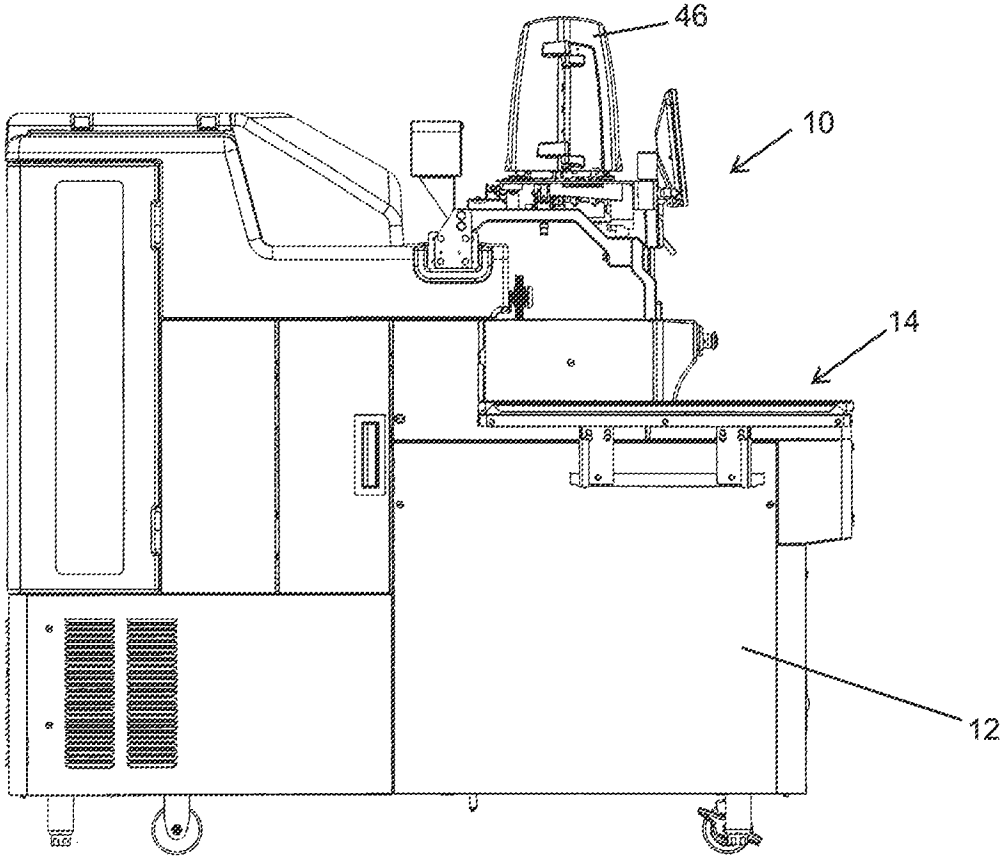
FIG. 2 shows a side elevation of the wrapping machine.
Figure 3:
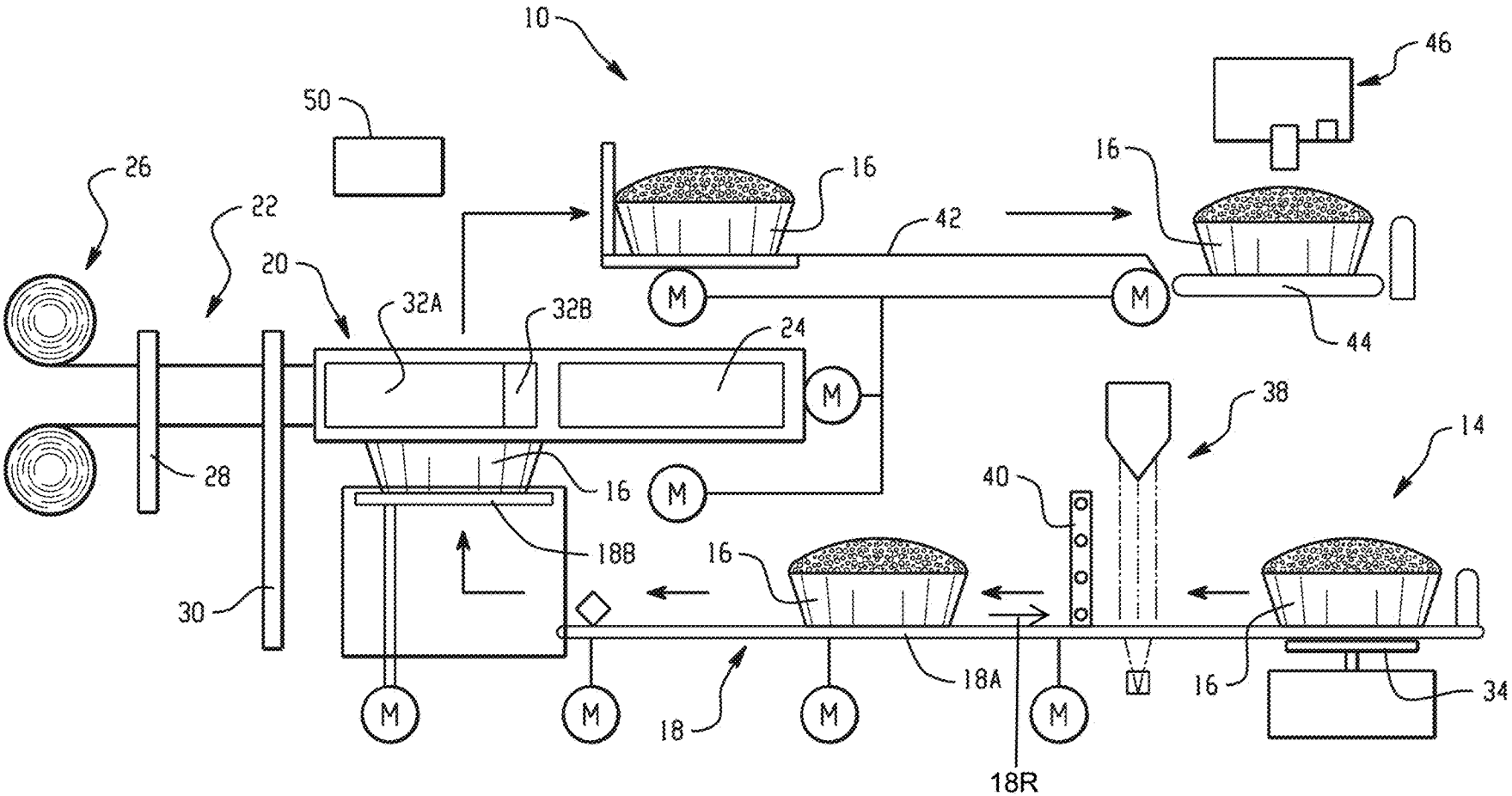
FIG. 3 shows a schematic side view depicting package travel through the wrapping machine.

Referring to FIGS. 1-3, a food product wrapping machine 10 includes an inner frame and outer housing 12. An inlet area 14 provides a location at which products to be wrapped (e.g., food items 16, such as meats in trays) are input to the machine for wrapping in plastic film. The inlet area 14 is part of a conveying system 18 that carries packages into the machine (right to left in FIGS. 2 and 3) and then up into a wrap station 20 at which the food products are wrapped. Here the conveying system includes one or more horizontal conveyors 18A that feed from the front of the machine back to an elevator mechanism 18B. A film dispensing system 22 is provided for drawing out film over food products at the wrap station 20 (e.g., under control of a film gripper 24 that moves left to right in FIG. 3 in order to draw off film from one or more film rolls 26). Where more than one film roll is provided (e.g., of differing film widths), an actuatable film selector 28 provides the ability to select the desired film for a given wrap operation (e.g., depending upon size of the food product). An actuatable film knife 30 is provided to cut the film at the appropriate time to enable the wrap operation to be completed. The wrap station may include side clamps 32A, 32B to grip the lateral sides of the film, as well as side underfolders and a rear underfolder (not shown).

A weighing mechanism 34 is located at the inlet area for weighing the food product as it is placed into the machine. Once a stable weight is determined, the food product 16 is moved laterally into the machine through a light curtain imaging system 38 and past a height sensor array 40 for determining size of the food product and location of the food product on the conveyor. Part of the horizontal conveying system 18A may be controllably shifted (e.g., into or out of the page in FIG. 3) as necessary to assure that the food product is properly centered when it is transferred onto the elevator mechanism 18B. After the food product is moved up into the wrap station 20 and wrapped, the wrapped food product is conveyed by a conveyor 42 back toward the front of the machine and deposited onto another horizontal conveyor 44, which here moves left or right (into or out of the page in FIG. 3). The conveyor 42 includes an associated sealer belt that heats the bottom of the wrapped food product to seal the film, and a label printing mechanism 46 prints and applies a pricing label to the wrapped food product. An exemplary controller 50 is shown for controlling machine operation. As used herein, the term controller is intended to broadly encompass any circuit (e.g., solid state, application specific integrated circuit (ASIC), an electronic circuit, a combinational logic circuit, a field programmable gate array (FPGA)), processor(s) (e.g., shared, dedicated, or group—including hardware or software that executes code), software, firmware and/or other components, or a combination of some or all of the above, that carries out the control functions of the machine or the control functions of any component thereof.

Figure 4:
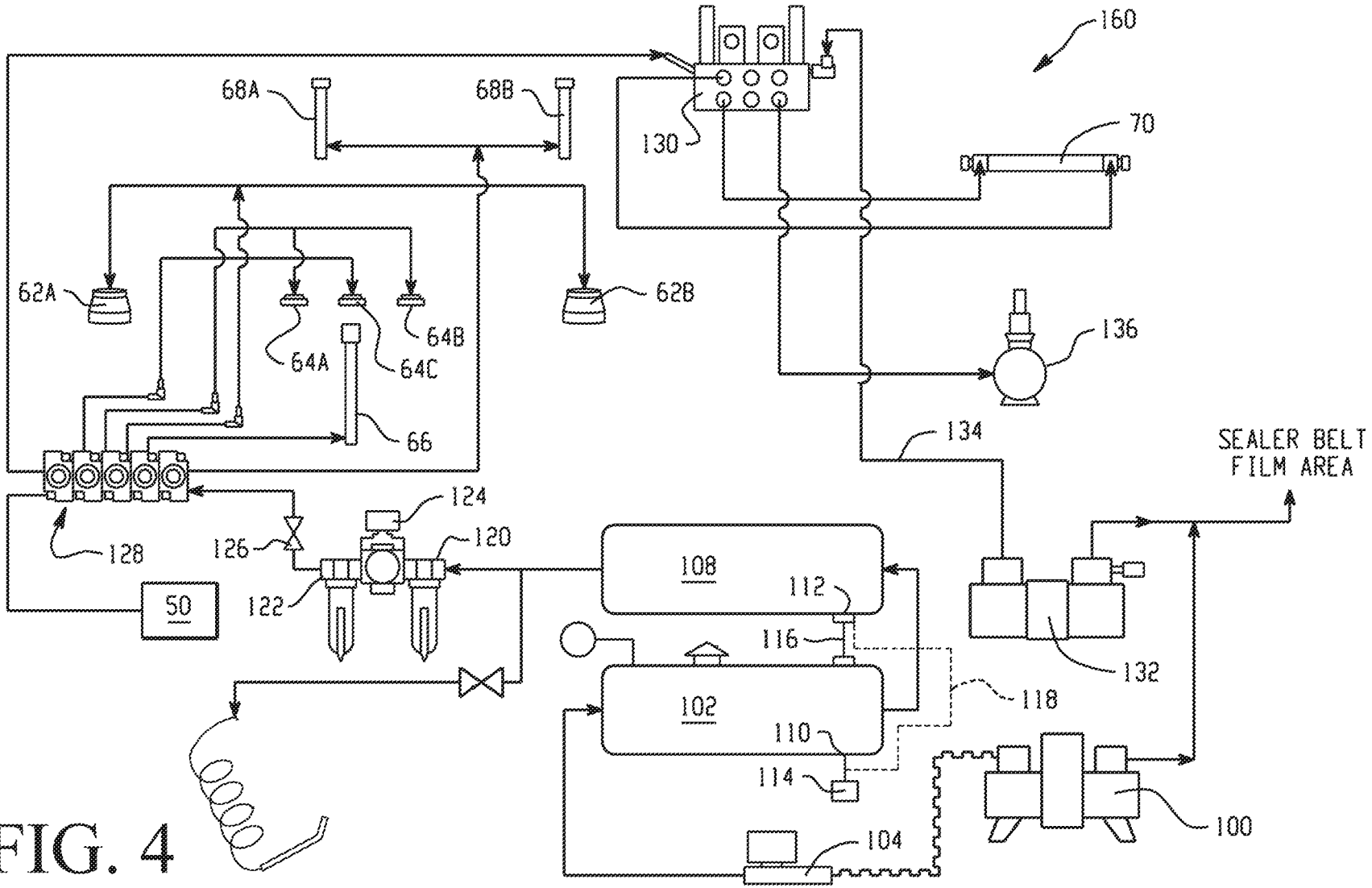
FIG. 4 shows a pneumatic arrangement of the wrapping machine.

Various motors M are shown and are used primarily for movement of the conveyor components, gripper components and underfolders. However, a plurality of pneumatic components may also be provided for control of component movement, where each pneumatic component is actuatable by delivery of pressurized air. By way of example, FIG. 4 shows an exemplary pneumatic arrangement 60 for the wrapping machine. The illustrated system employs pneumatics to perform actuation of various components and utilizes a design that can remove the heat and humidity from the compressor and the environment from which the compressor is pulling air. This design solves the problem of maintaining a dew point within the pneumatic system that is below the ambient temperature of the environment (in this case the environment is typically the meat processing environment, which may be 50° F. or less, such as less than 46° F.).

The exemplary automated wrapping system includes a pair of pneumatic cylinders 62A, 62B to actuate the side clamps 32A, 32B, a set of pneumatic gripper cylinders 64A, 64B, 64C to actuate the gripping operation of the film gripper 24 (which has a center grip and two side grips), a pneumatic cylinder 66 to actuate the film knife assembly 30 to cut the film, a pair of film selector pneumatic cylinders 68A, 68B to select from the two film rolls, and a pneumatic cylinder 70 to actuate a label applier.

The air flow of the system starts at the compressor 100 with arrows indicating the flow through all key components. The compressor 100 includes an air inlet and an air outlet and generates a high pressure (e.g., at least 120 PSI, such at least 130 PSI (e.g., a 135 PSI target)) as it moves air from the walk-in cooler environment into a closed pressure system. To reduce overall noise, the compressor 100 may be sized that is only needs to be operated at no more than a 50% duty cycle, such as at most a 40% duty cycle or at most a 35% duty cycle to provide adequate air pressure even when the wrapping machine is wrapping at a rated high speed of 25 or more PPM.

An unloader valve 104 with associated pressure sensor is provided between the compressor 100 and receiver tank 102 to remove pressure in the supply line between the compressor 100 and the receiver tank 102 to allow the compressor to start without back pressure. The air outlet of receiver tank 102 feeds to an air inlet of a receiver tank 108. Receiver tank 102 includes a drain outlet 110 and receiver tank 108 includes a drain outlet 112. Drain outlet 110 feeds to a controllable drain valve 114. Here, the drain outlet 112 feeds along a path 116 into receiver tank 102 for eventual draining through drain outlet 110. However, alternatively drain outlet 112 could feed along a separate external path 118 to the input side of the drain valve 114.

The air outlet of receiver tank 108 feeds to path that leads to an air inlet of an auto drain trap 120, which in turn has an air outlet that feeds to an air inlet of another auto drain trap 122. A pressure regulator 124 is positioned between the two auto drain traps and reduces the pressure to a desired set level for component operation. The air outlet of auto drain trap 122 feeds to a low pressure dump valve 126, which in turn feeds to a valve manifold 128 with a plurality of controllable valves that enable controlled and selective delivery of pressurized air to the various pneumatic components.

Another valve manifold 130 selectively connects the high pressure air flow to the label applier cylinder, at either side according actuation desired. A vacuum pump 132 creates a vacuum pull along path 134 that also feeds through the valve manifold 130 for selectively controlling application of the vacuum to an label application wand 136 to hold a label at the end of the wand.

Each of the pneumatic components may include associated sensor(s) for detecting home position of the component and/or the end of travel position of the component by detecting movement and/or position of the actual component (e.g., pneumatic cylinder) itself of by detecting movement/and or position of the device (e.g., gripper or film knife) that is actuated by the pneumatic component. The sensor feedback is utilized in the overall control scheme for wrapping operations.

Figure 5:
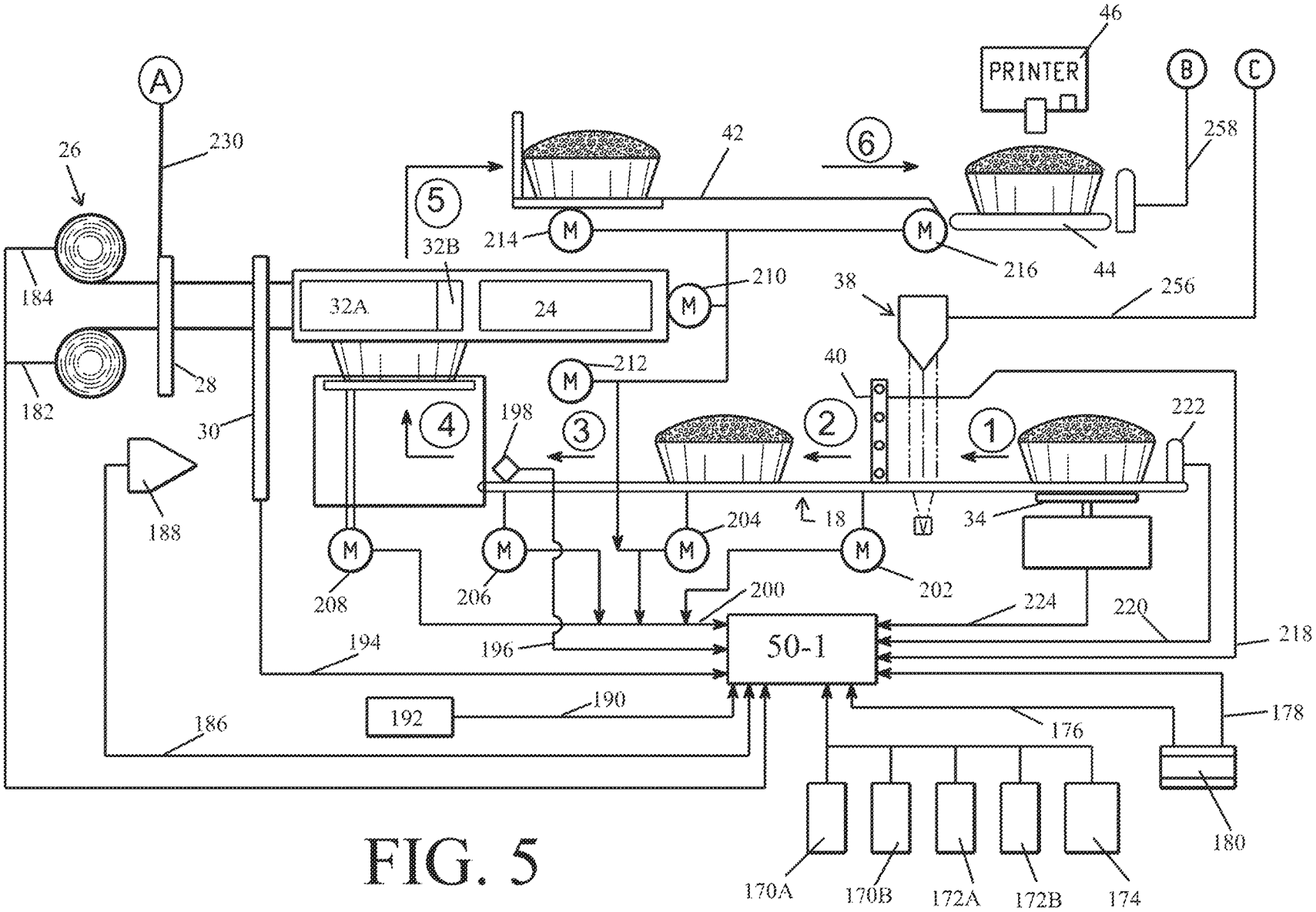
FIGS. 5 and 6 show a control system of the wrapping machine.
Figure 6:
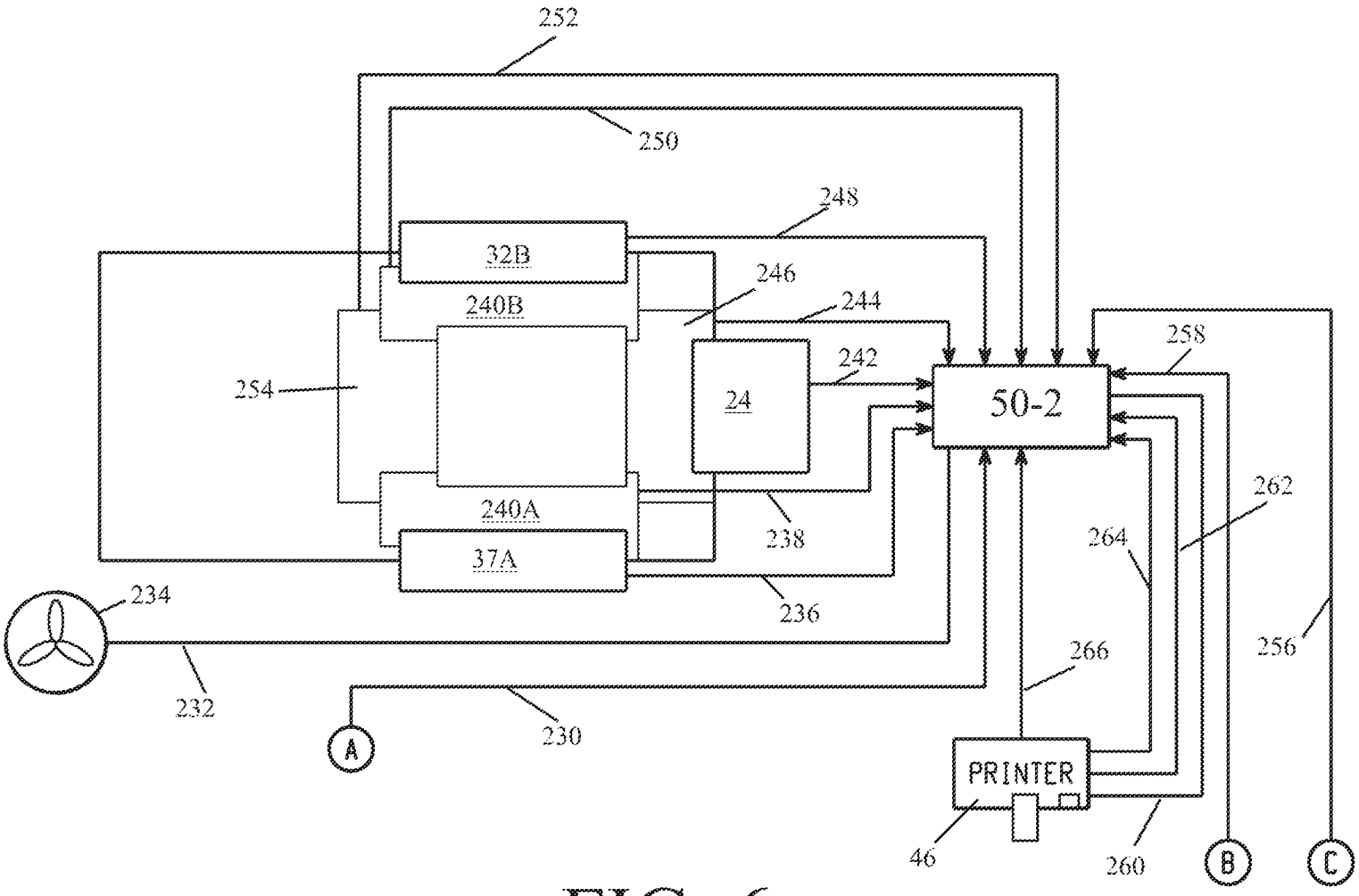

In this regard, referring to the control schematic of FIGS. 5 and 6, an exemplary wrapping machine control system is shown (side view in FIG. 5, with overhead view of the wrap station in FIG. 6). The illustrated machine controller is shown as boards/blocks/segments 50-1 and 50-2.

Controller segment 50-1 receives the following inputs: open/closed sensor inputs from rear doors 170A, 170B and side doors 172A, 172B and a machine canopy door 174; an in-rush sense input 176 and voltage sense input 178 (e.g., 24 VDC) from a power supply board 180; film roll movement inputs 182 and 184 (e.g., encoder ticks) from the respective film rolls 26; an ambient temperature input 186 from a thermistor 188; at pump and in-system pressure sensor inputs 190 from various pressure sensors 192 of the system; knife start and end point inputs 194 from sensors associated with the film knife 30; a package detection input 196 from a sensor 198 at the entry of the elevator; motor movement inputs 200 (e.g., encoder ticks) from the upstream conveyor motor 202, lateral shifter 204, downstream conveyor motor 206, elevator motor 208, gripper pull and folder motors 210 and 212, outfeed conveyor motor 214 and sealer belt conveyor motor 216; height sensor array inputs 218 from the array 40; a pusher home position input 220 from a sensor (e.g., Hall effect) that detects pusher 222 as it moves past the sensor; and weight indication input 224 from the weigher 34 at the infeed.

Controller segment 50-2 receives the following inputs: up/down inputs 230 from sensor(s) associated with the film selector 28; an on/off input 232 from a fan 234 associated with the compartment in which the compressor and vacuum pump are located; open/closed sensor inputs 236 from side clamp 32A; home position sensor and movement (e.g., encoder tick) inputs 238 from side underfolder 240A; open/closed sensor inputs 242 from gripper 24, home position sensor and movement (e.g., encoder tick) inputs 244 from front underfolder 246; open/closed sensor inputs 248 from side clamp 32B; home position sensor and movement (e.g., encoder tick) inputs 250 from side underfolder 240B; home position sensor and movement (e.g., encoder tick) inputs 252 from rear underfolder 254; package size and centering offset inputs 256 from the imaging system 38; package leading edge and trailing edge sensor inputs 258 from a sensor(s) associated with the sealer belt conveyor 44; start point and end point inputs 260 from sensors associated with a label applier; a label taken input 262 from a sensor at the label output of the printer 46; start and end point inputs 264 from sensor(s) associated with a label wand; and a printer locked in operating position input 266 from a sensor associated with a movable printer support platform.

FIG. 5 illustrates exemplary stages involved in wrapping a tray. The stages are numbered 1 thru 6 per the number in a circle designations illustrated in the diagram. The diagram shows various subsystems and components that are part of each stage that both interact with the tray and its contents during the wrap process as well as provide feedback to a controller (e.g., here made up of controller segments 50-1 and 50-2) running the system. Each stage is presented with the command, control, and feedback necessary to move the tray and its contents to be wrapped from that stage to the next, per the following description.

Start

The operator places the product (meat, seafood, deli, etc) into a tray that is to be wrapped by the automatic wrapper. At the beginning of this stage the automatic wrapper is powered and various self-checks are performed such as 24 VDC and inrush of current from power supply, and air pressure output of the compressor are within acceptable ranges. The heater under the sealer belt is brought up to temperature to be ready to seal film during stage 6. Continuous control of the temperature of the pneumatic housing area where the air compressor and vacuum pump are located is achieved by measuring the thermistor value in that location and turning the pneumatic housing fan on and off as appropriate in comparison to one or more threshold temperatures (e.g., a set minimum temperature and a set maximum temperature that together define an acceptable operating temperature range). Excess heat may be removed from the pneumatic housing area and pushed into the wrapper cavity to assist in heating the film as wrapping occurs. All safety interlocks are verified to assure that all rear, side, and canopy doors of the machine are closed. Various components such motors, elevator, side clamps and grippers are actuated and verified to be functional.

Assuming all positive feedback from this system check, transition to Stage 1 will occur. Per FIG. 7, exemplary fault conditions that can prevent transition to Stage 1—Primary Intake include lack of stable weight (SW), lack of a valid line pressure (VLP) in the pneumatic system, lack of a primary intake clear indication (PIC), lack of primary, secondary and elevator portions of the conveying system in a ready state (PRS, SRS, ERS), lack of a high voltage ready indication (HVR). These and other potential fault conditions can be designated Fault A conditions for the purpose of fault alerting and reporting.

Stage 1—Primary Intake

Assuming all positive feedback from this system check the operator will be allowed to enter (e.g., via a user interface such as a touch-screen display) a product look-up number (PLU) identifying the product in the tray, which enables a data pull including price per pound, description of product, label information etc. The operator will then place the tray anywhere in the intake area of the machine, including potential off center placement and placement at different angles to the front of the intake. The weighing system is located under the intake and detects the weight of the product. Once a stable weight is achieved the tray is moved into the machine by the infeed conveyor and pusher elements automatically align the sides of tray to be parallel with the intake side walls. The tray may still be off center to the intake chute. The tray will then enter the camera and light curtain vision system with a height sensor array that identifies the height and width of the package as well as how far the package is offset from center. As the tray moves encode tick feedback from all motors moving the belt that the tray is on will keep track of the relative location of the package as it moves down the infeed chute on the conveyor to stage 2.

Exemplary fault conditions that can prevent transition to Stage 2—Secondary Intake include lack of a home sensor cleared indication (HSR), lack of a valid package dimension indication (VPD), lack of a valid package centering indication (VPC) (e.g., the package is so far off it will not be able to be centered by the machine), lack of a secondary conveyor portion ready indication (SRS). These and other potential fault conditions can be designated Fault B conditions for the purpose of fault alerting and reporting.

Stage 2—Secondary Intake

Based on the identified offset of the package from infeed center the controller commands a shifter to shift the chute assembly before the elevator so the tray is centered when it is fed onto the elevator before wrap. Based on the weight of the package and PLU information entered by operator a label is printed and the label wand is in the up position below the label. Vacuum pressure is applied through the label wand so the label sticks to the surface of the wand. The label is now staged for application to the tray film once the tray arrives in Stage 6.

Exemplary fault condition(s) the can prevent transition to Stage 3—Elevator is lack of a secondary conveyor portion ready indication (SRS). This fault and other potential fault conditions can be designated Fault C conditions for the purpose of fault alerting and reporting.

Stage 2A—Film Pull Check

Figure 7:
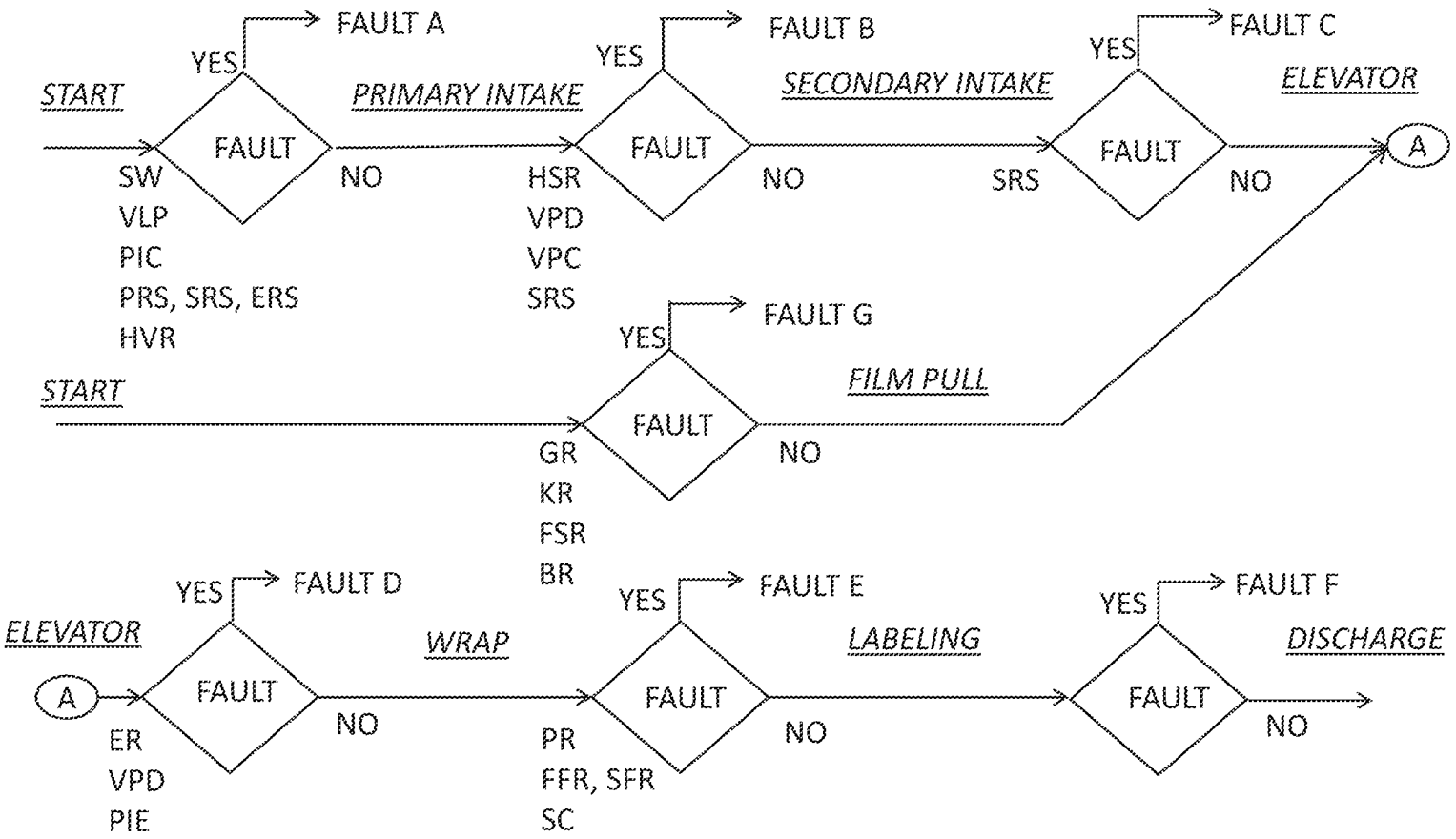
FIG. 7 shows an exemplary stage flow process.

As seen in FIG. 7, a parallel control track includes a Film Pull check stage in which the status of the machines readiness for film pull is verified. Exemplary Fault conditions that can prevent transition to Stage 3—Elevator on this track include lack of a gripper ready indication (GR), lack of a knife ready indication (KR), lack of a film selector ready indication (FSR) and lack of a fil roll brake ready indication (BR). These faults and other potential fault conditions can be designated Fault G conditions for the purpose of fault alerting and reporting.

Stage 3—Elevator

A tray detect sensor identifies the leading and trailing edge of the tray and identifies when the package is on the elevator. The elevator then lifts the tray up into the wrap zone. Exemplary fault conditions that can prevent transition to Stage 4—Wrap include lack of an elevator ready indication (ER), lack of a valid package dimension indication (VPD), lack of a package index on elevator indication (PIE). These faults and other potential fault conditions can be designated Fault D conditions for the purpose of fault alerting and reporting.

Stage 4—Wrap

A gripper is then commanded to grip and pull film from the film selector based on home and end travel feedback for the gripper. Feedback is also provided on when the gripper is open and closed and the film brake is on before the film is pulled. Feedback from the film roll rotation further confirms that film has been pulled versus no pull or film has been torn. Once the gripper reaches a full pull which is confirmed by an end point sensor the side clamps move in and grab the sides of the film to be stretched. The amount of film pulled is dependent on the tray size and height. The opening and closing of the side clamps is confirmed by sensors on each assembly. Once closed the film is pulled based on feedback of tray size and height and the elevator raises the tray into the bottom of the taught film and the film is cut by the knife. Feedback of the knife cut comes from a sensor that detects the up and down maximum travel of the knife assembly. Side under folders and front and read under folders are then commanded to pull the film under the tray and press it against the bottom of the tray.

Exemplary fault conditions that can prevent transition to Stage 5—Labeling include lack of a pusher ready indication (PR), lack of a front folder or side folder ready indication (FFR, SFR) and lack of a side clamp indication (SC). These faults and other potential fault conditions can be designated Fault E conditions for the purpose of fault alerting and reporting.

Stage 5—Labeling

The tray and product are now wrapped at this point. However, sealing of the package has not occurred. The front underside folder and the pusher are operated to push the package down the top chute with feedback from home and end point sensors designating start and end of travel of pusher as well as motor encoder ticks providing relative distance of travel between the home and end point. The elevator is lowered to its home position, the gripper, side clamps, and under folders and knife are retracted to their home positions ready for the next package to be wrapped.

The pusher pushes the tray on the sealer belt while the underside folder retracts to accommodate the next package. Once the tray passes the leading and trailing edge detector the label wand that is holding the label via vacuum pressure is rotated to a down position. The label taken sensor is tripped indicating the label has been removed from the printer. The label applier hand is lowered after the label wand reaches the down position which is indicated by feedback and applies the label on to the top of the film on the tray.

Stage 6—Discharge

The sealer belt has heat applied to seal the film under the tray as the tray is moved on the belt. After labeling is complete, the package is then moved down the heated sealer belt by a motor for operator retrieval.

The stages describe the control and feedback that will occur upon the successful wrap of film of product on a tray. If any of the feedback to the control system indicates an issue where the system cannot continue the system immediately stops the wrap procedure. Issues such as faulty hardware, tray and product that would be damaged, or a machine safety issue will cause the system to stop the wrap cycle. At this point if a tray has entered the intake chute the operator would be required to remove it. To assist in removal, and if the tray is not too far along in the machine, the conveying system could be operated in reverse, per arrow 18R, to move the tray back out of the machine to the infeed set down location at which the operator can easily pick-up the tray. A diagnostic procedure is then run after confirmation from the operator that all trays have been removed from the system to further refine the cause of the issue.

Not all issues require the wrapper stop. Since the control system is designed as a state machine with wrap stages and sub stages must all complete successfully before the following stage can execute. This means that the automatic wrapper can run at a slower pace and still wrap trays. This of course means that the overall Trays Per Minute output by the system may not be as high as desired, but the alternative is no wrapping at all. The control system does keep track of desired response times for the moving parts of the system and if they are not met by for the worst case scenario the control system will provide feedback to the operator that the automatic wrapping system cannot continue to wrap and needs to be serviced.

The state machine operation implemented by the control system enhances the ability to wrap properly with different film gauges and/or materials. Predictive maintenance for the machine is also enabled. In particular, during a machine set-up operation the timing for various components to move can be detected and stored in memory as a base time or reference time. Over the operating life of the machine, if the timing for movement of one or more components departs from the stored time by an excessive amount and/or changes significantly over a defined short period of time, the control system can initiate an alert. The alert(s) can be to the machine user interface, advising the operator to take some corrective action and/or call service. The alert(s) could also be communicated directly to a service technician and/or can be printed on labels. The machine can store historic state times for the various components, enabling a technician to retrieve the data to look for patterns indicative of certain problems or potential performance issues. By way of example, Table 1 below shows exemplary tracked and stored movement/response times for various components according to specific package types being wrapped and given target wrapping speed, recognizing that the response times may vary according the nature of the wrap required.

TABLE 1

Exemplary Component Response Times For Wrap Conditions

| | Wrap1 (Package Type 1 and Set Speed S1) | | | | Wrap2 (Package Type 2 and/or Set Speed S2) | | | |
|---|---|---|---|---|---|---|---|---|
| | Ref Time | DayX | DayY | DayZ | Ref Time | DayX | DayY | DayZ |
| Component 1 | 0.22 sec | 0.22 sec | 0.23 sec | 0.23 sec | 0.28 sec | 0.28 sec | 0.29 sec | 0.29 sec |
| Component 2 | 0.15 sec | 0.15 sec | 0.15 sec | 0.15 sec | 0.19 sec | 0.19 sec | 0.19 sec | 0.19 sec |
| Component 3 | 0.18 sec | 0.19 sec | 0.24 sec | 0.32 sec | 0.22 sec | 0.23 sec | 0.30 sec | 0.39 sec |

As seen in Table 1, the expected or desired response time (Ref Time) for a given component (e.g., any of Component 1, Component 2 or Component 3) can vary based upon the wrap being performed (e.g., Wrap1 or Wrap2). As reflected in the table, the response time for Component 2 remains stable over time. The response time for Component 2 varies slightly, but within tolerable amounts. However, the response time for Component 3 degrades substantially, and the controller may be configured to generate an alert due the significant degree of degradation. Of course, the response times for many more components and many more wrapping conditions could be tracked and stored, and Table 1 is exemplary only.

It is to be clearly understood that the above description is intended by way of illustration and example only, is not intended to be taken by way of limitation, and that other changes and modifications are possible.

What is claimed is:

1. A wrapping machine for wrapping a trayed food product, comprising:

a wrap station at which the trayed food product is wrapped;

a film dispensing station for drawing out film over the trayed food product at the wrap station;

a conveying system for moving the trayed food product along a path from an input station to the wrap station;

a controller operatively connected to operate the conveying system, a plurality of components of the film dispensing station and a plurality of components of the wrap station, wherein the controller is configured as a state machine with sequential wrap stages, such that each wrap stage must be successfully completed before the controller initiates a next wrap stage;

wherein the controller is configured such that, upon detection of a fault condition that prevents further wrap stage sequencing for the trayed food product, the controller determines whether the trayed food product is in a position to be moved back to the input station and, if so, operates the conveying system to move the trayed food product back to the input station.

2. The wrapping machine of claim 1 wherein at least one wrap stage includes multiple sequential sub-stages, wherein each sub-stage must be successfully completed before the controller initiates a next sub-stage.

3. The wrapping machine of claim 1 wherein the controller receives feedback regarding one or more components from one or more of a home or start sensor, an end of travel sensor and/or an encoder associated with the component to verify completion of component operation for a given stage.

4. A wrapping machine for wrapping a trayed food product, comprising:

a wrap station at which the trayed food product is wrapped;

a film dispensing arrangement for drawing out film over the trayed food product at the wrap station;

a conveying system for moving the trayed food product along a defined path from an input station to the wrap station;

a controller operatively connected to operate the conveying system, components of the film dispensing station and components of the wrap station;

multiple feedback arrangements including at least one feedback arrangement associated with a component of the wrap station and a feedback arrangement associated with a component of the film dispensing station, wherein each feedback arrangement includes one or more of a respective home or start sensor, a respective end of travel sensor and/or a respective encoder for tracking component movement;

wherein the controller is configured to carry out a wrap operation in a plurality of sequential wrap stages and the controller utilizes feedback from one or more of the feedback arrangements to assure that one wrap stage is complete before initiating a next sequential wrap stage;

wherein the controller is configured such that, upon detection of a fault condition that prevents further wrap stage sequencing for the trayed food product, the controller determines whether the trayed food product is in a position to be moved back to the input station and, if so, the controller operates the conveying system to move the trayed food product back toward the input station and to a set position for operator removal.

5. The wrapping machine of claim 4 wherein at least one wrap stage includes multiple sequential sub-stages, wherein each sub-stage must be successfully completed before the controller initiates a next sub-stage.

* * * * *